US007060239B2

(12) United States Patent
Shklover et al.

(10) Patent No.: US 7,060,239 B2
(45) Date of Patent: Jun. 13, 2006

(54) QUASICRYSTALLINE ALLOYS AND THEIR USE AS COATINGS

(75) Inventors: Valery Shklover, Zurich (CH); Maxim Konter, Klingnau (CH); Anton Kaiser, Baden-Daettwil (CH); Kenneth Franklin Kelton, St. Louis, MO (US)

(73) Assignee: Alstom Technology Ltd., Baden (CH)

( * ) Notice: Subject to any disclaimer, the term of this patent is extended or adjusted under 35 U.S.C. 154(b) by 440 days.

(21) Appl. No.: 10/401,696

(22) Filed: Mar. 31, 2003

(65) Prior Publication Data

US 2004/0191154 A1 Sep. 30, 2004

(51) Int. Cl.
*C22C 14/00* (2006.01)

(52) U.S. Cl. ..... 423/326; 423/328.1; 423/328.2; 420/418; 420/420; 501/134; 501/153; 501/154

(58) Field of Classification Search ..... 423/326, 423/328.1, 328.2; 420/418, 420; 501/134, 501/153, 154
See application file for complete search history.

(56) References Cited

U.S. PATENT DOCUMENTS 5,207,982 A 5/1993 Nazmy et al. ..... 420/418
5,256,369 A * 10/1993 Ogawa et al. ..... 420/420

OTHER PUBLICATIONS

Search Report from EP 04101277.4 (Apr. 30, 2004).
Zhang, X., et al., "Icosahedral phase formation in $Ti_{68-x}Cr_{32}Si_x$ alloys", Philosophical Magazine Letters, 62:4, pp 265–271 (Kenneth F. Kelton 1990).
Libbert, J.L., et al., "Large unit cell crystal approximant in Ti–Cr–Si alloys", Journal of Non–Crystalline Solids 153&154, pp. 53–57 (Elsevier Science Pubs. B.V. 1993).
Kocherjinsky, Yu. A., et al., "Phase Diagrams of Metallic Systems," Nauka, Moscow, (1971), pp. 245–249.
Libbert, J.L., et al., "Structural determination of a I/I rational approximant to the icosahedral phase in Ti–Cr–Si alloys," Phys. Rev. B., 49, (1994), pp. 11675–11679.
Libbert, J.L., et al., "Oxygen in Ti–(Cr, Mn)–SI icosahedral phases and approximants," Phil. Mag. A, 79, (1999), pp. 2209–2225.
Kim, J.Y., et al., "Neutron diffraction determination of hydrogen atom locations in the α(TiCrSiO) I/I crystal approximant," Phys. Rev. B., 60, (1999), pp. 3912–3919.
Archambault, P., et al., "Thermal and Electronic Properties of an AlCoFeCr Approximant of the Decagonal Phase," Mat. Res. Soc. Symp. Proc., 553, (1999), pp. 409–414.
Dubois, J.M., "New prospects from potential applications of quasicrystalline materials," Mat. Sci. and Engineering, 4, (2000), pp. 294–296.
Pfaff, E., Bericht 72–00 (Sep. 20, 2000) of Rheinisch–Westfälische Technische Hochschule Aachen, 13 pp.
Nonaka, K., et al., "Effect of Oxygen in Titanium on Reaction Diffusion between Ti and Al," Materials Transactions, 42, (2001), pp. 1731–1740.

* cited by examiner

*Primary Examiner*—David Sample
(74) *Attorney, Agent, or Firm*—Cermak & Kenealy, LLP; Adam J. Cermak

(57) ABSTRACT

The present invention relates to an icosahedral, quasicrystalline compound or compound present in the form of an approximant having the nominal composition: $Ti_vCr_wAl_xSi_yO_z$, in which v=60–65; w=25–30; x=0–6; Y=8–15; z=8–20; and in which the atom percent of oxygen is in the range of between 8 and 15%, and that of aluminum in the range of between 2 to 5%. Due to their layered structure and ceramic intermediate layers, compounds of this type exhibit excellent properties, in particular for use as coatings for gas turbine components, such as for example, rotor blades or guide vanes.

20 Claims, 10 Drawing Sheets

QUASICRYSTALLINE ALLOYS AND THEIR USE AS COATINGS

FIELD OF INVENTION

The present invention relates to quasicrystalline compounds or compounds present in the form of approximants, to a method for manufacturing such compounds and to uses of compounds of this type, in particular in conjunction with the coating of components that are exposed to heat.

PRIOR ART

The atomic structure, basic stereochemistry and the mechanism of the phase growth of Ti—Cr—Si—O-type structures are known and have, for example, been described in the following scientific articles: J. Y. Kim, W. J. Kim, P. C. Gibbons and K. F. Kelton: Neutron Diffraction Determination of Hydrogen Atom Locations in the a(TiCrSiO) 1/1 Crystal Approximant, Phys. Rev. B, 60, (1999); J. L. Libbert, K. F. Kelton, A. L. Goldman and W. B. Yelon: Structural Determination of a 1/1 Rational Approximant to the Icosahedral Phase in Ti—Cr—Si Alloys, Phys. Rev. B, 49, 11675 (1994); J. L. Libbert, J. Y. Kim and K. F. Kelton: Oxygen in Ti(Cr,Mn)—Si Icosahedral Phases and Approximants, Phil. Mag. A, 79, 2209 (1999). It is also known, amongst others, that oxygen plays a major role in the stabilization of the i-phase (icosahedral, quasicrystalline phase) or its approximant. An approximant is a chemical structure with a composition similar to that of an associated quasicrystal, wherein the approximant exhibits periodic structures with very large unit cells and local arrangement closely resembling that of an associated quasicrystal. In this context the approximant is designated α(TiCrSiO) or 1/1 phase, which is the most important phase in such tested alloys. Neutron studies indicate that the oxygen atoms are arranged at the octahedral positions, in which there is a probable bond with the titanium atoms. Hence, based on energy computations, this suggests the presence of a network of octahedral cites.

It is thus possible to view titanium-based quasicrystalline materials as metallic alloys with internal ceramic layers.

A study was done on the effect of the oxygen content in titanium on the reaction diffusion for the Ti/Al pairing, in which cast Ti/Al was tested using 5 mol % oxygen and suitable tempered (annealed) material (K. Nonaka, H. Fujii and H. Nakajima: "Effect of Oxygen in Titanium on Reaction Diffusion Between Ti and Al. Materials," Transactions, 42, 173 (2001)). Here, growth of an intermediate layer in the diffusion pairs of the cast Ti(O)/Al was suppressed as opposed to the growth in the Ti/Al diffusion pairs. The resultant proposed suppression mechanism includes the formation of aluminum oxide from $TiAl_3$ and Al at the interface between the intermediate layers.

The thermal conductivity of quasicrystalline alloys and approximants thereof, in which only phonons of longer wavelength are able to propagate, is less than that of standard metal alloys. This was described, for example, in the following publications: P. Archambault, P. Plaindoux, E. Belin-Ferre and J. M. Dubois: "Thermal and Electronic Properties of an AlCoFrCr Approximant of the Decagonal Phases," Quasicrystals, MRS, 535, 409 (1999); J. M. Dubois: "New Prospects From Potential Applications of Quasicrystal Materials", Mat. Sc. and Engineering, 294–296, 4 (2000). The thermal conductivity of exclusively aluminum-based quasicrystal alloys (or approximants thereof) has also been investigated.

BRIEF DESCRIPTION OF THE INVENTION

Accordingly, the object of the present invention is to provide a novel quasicrystalline compound or a compound present in the form of an approximant. Such a compound has advantageous properties of the kind required, in particular, in conjunction with its use as a coating on components exposed to hot gases of the type found, e.g. in gas turbines. Thus, said compound or class of compounds is intended to exhibit corresponding strength as well as stability and density and to have low thermal conductivity. Moreover, it will form if possible a diffusion barrier for oxygen, exhibit high stability relative to oxidation and also potentially enable observation of diffusion reactions between the compound and the material to which the compound is applied.

The object is achieved in that the compound has an icosahedral, quasicrystalline or suitable approximant structure and a nominal composition of the following type:

$$Ti_vCr_wAl_xSi_yO_z$$

in which v=60–65; w=25–30; x=0–6; y=8–15; z=8–20. In order for a suitable quasicrystalline or approximant structure to actually form, it is important that the atom percent of oxygen fall within the range of 8 to 15%. Below this range the desired structure will not form, and above this range an oxide phase will form. Further, the atom percent of aluminum is advantageously fixed within a range of 2 to 5%. It is understood that suitable combinations of these materials are also contemplated.

The heart of the invention is thus seen in exploiting the normal stability and density of titanium alloys, as well as the low thermal conductivity of quasicrystalline alloys. Moreover, the ceramic intermediate layers serve to inhibit diffusion through the layer (diffusion barriers). The proposed compounds also have improved stability relative to oxidation as opposed to standard titanium alloys, and they allow observation of the diffusion reaction between the titanium-based coatings and the base material (e.g. aluminum or steel). Accordingly, coatings made of such materials may allow for reduced manufacturing costs and may enable increased protection of coated gas turbine components. In other words, coatings of this type exhibit a high degree of resistance to conditions (high temperature, corrosive environment, severe mechanical stresses, etc.), which typically occur in gas turbines (notably in conjunction with rotor blades and guide vanes).

According to a first preferred embodiment of the present invention, the parameters cited above are set to the following: v=60; w=30; x=0–3; y=8–15 (with 8–10 being especially preferred); z=8–20 (with 8–10 being especially preferred). In order for the desired structure to actually form, the atom percent of oxygen should be fixed within the range of between 8 to 12%, that of aluminum within the range of between 1.5 to 3%.

Further enhanced properties are achieved by setting the parameters to the following: v=60; w=30; x=0–2; y=8–10; in which the atom percent of oxygen is in the 10% range and the atom percent of aluminum is within a range of 1.5 to 2.5%. Specifically, the following compositions in particular may be advantageously used: $Ti_{60}Cr_{32}Si_4(SiO_2)_4$; $Ti_{60}Cr_{25}Si_5(SiO_2)_{10}$; $Ti_{65}Cr_{25}Si_{2.5}(SiO_2)_{7.5}$; $Ti_{60}Cr_{30}(SiO_2)_{10}$; $Ti_{60}Cr_{30}Al_2Si_3(SiO_2)_5$; $Ti_{60}Cr_{30}Al_3Si_2(SiO_2)_5$; $Ti_{60}Cr_{30}Al_2Si_3(SiO_2)_5$; $Ti_{60}Cr_{30}Si_5(SiO_2)_5$.

Further preferred embodiments of the compound according to the present invention are described in the dependent claims.

Additionally, the present invention relates to a method for manufacturing a compound of the type just described. The individual constituents or components are advantageously fused together in a cover gas or vacuum. This may be performed, for example in an arc. Other methods are also contemplated, such as, for example, sintering, PVD (physical vapor deposition), plasma spraying, etc.

According to an especially preferred embodiment of the method according to the present invention the material is also tempered. Preferably, after being fused in a cover gas the compound is tempered especially preferably in a furnace, in which the material is maintained preferably at a temperature in the range of 1000 to 1300° C. for a period of 80 to 200 hours, then allowed to cool in the furnace.

Tempering may be accomplished by different methods, e.g. step-wise, in which a scheme involving graduated increases or one involving graduated decreases in temperature, or a combination of such schemata, are employed.

As previously mentioned above, advantageous properties of the material emerge in particular in conjunction with its use as a coating. Accordingly, yet another embodiment of the method according to the present invention describes the application of the compound in the form of a coating to a material, utilizing in particular methods such as plasma spraying or vapor deposition, followed optionally by tempering.

Further advantageous embodiments of the method according to the present invention for manufacturing the compound and the material are outlined in the dependent claims.

Further, the present invention relates to the use of a compound as characterized above and as manufactured according to a method of the type described above. It involves using a work material of the aforementioned type as material for a component exposed to high temperatures, that is, one that is exposed in particular to, or surrounded by, hot gases. In particular, it involves, for example, a component of a gas turbine, a rotor blade or guide vane of a gas turbine being especially preferred.

A further preferred use in accordance with the present invention is characterized in that said compound is present as a coating, especially preferably, on the surface that is exposed directly to hot gases. In such case, a second functional layer made of said material may optionally be disposed underneath the coating, in particular for providing adhesion and as an additional barrier.

Typically, a coating of this type has a thickness in the range of between 10–400 μm, with a range of between 100 to 300 μm being especially preferred.

Further preferred uses according to the present invention are described below in the dependent claims.

BRIEF DESCRIPTION OF THE DRAWINGS

Embodiments of the present invention are described in greater detail with reference to the drawings, in which.

WAYS OF IMPLEMENTING THE INVENTION

Figure 1:
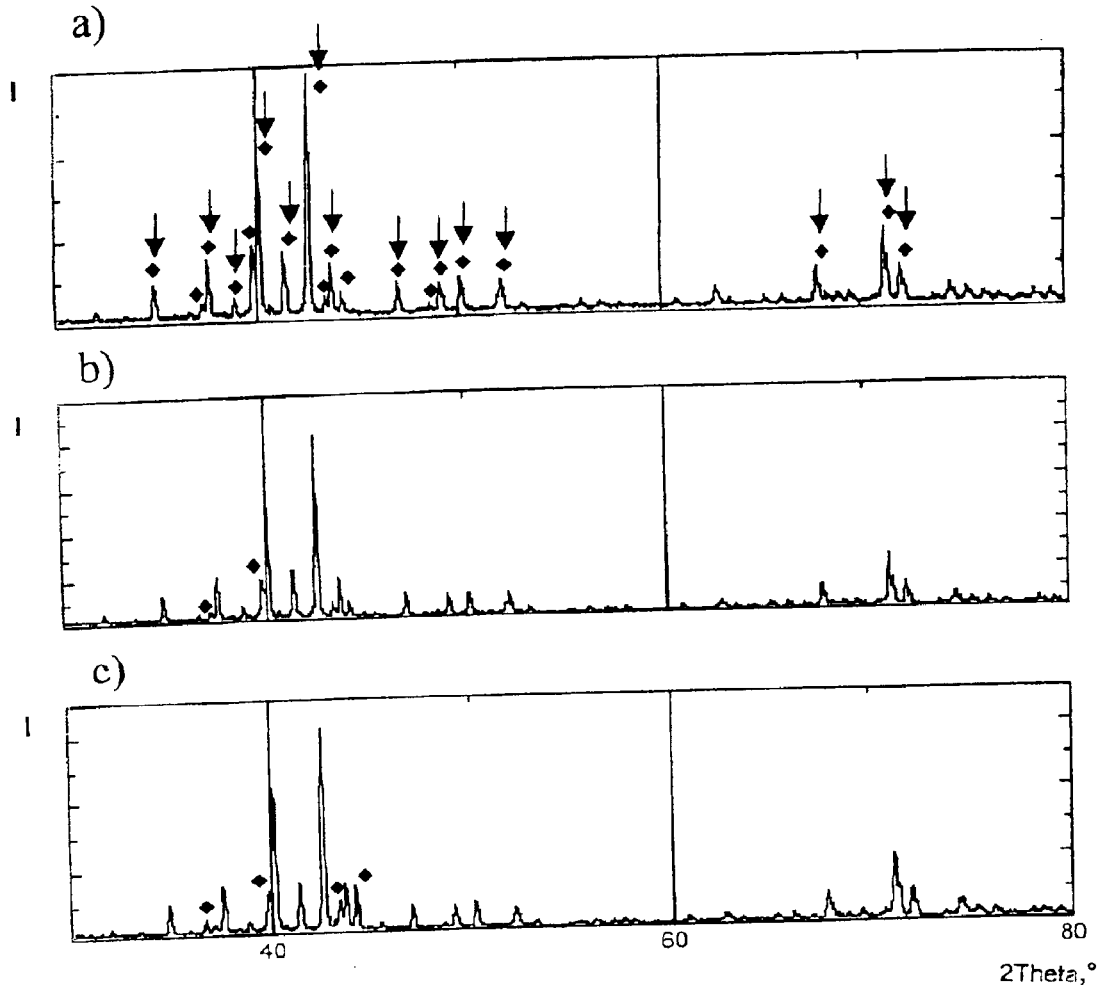
FIG. 1 displays X-ray diffraction data of the example T1-4, in which a) is the spectrum for a sample tempered in a zirconium dioxide crucible, b) is the spectrum for a sample tempered in a graphite crucible, and c) is the spectrum for a non-tempered sample.

Thermal stress as well as oxidation of gas turbine rotor blades and guide vanes while under the influence of high temperature, combined with oxidative and corrosive conditions reduces the potential working life and the maximum potential temperature design of the combustion process, thereby reducing the efficiency of the turbine on the one hand, while increasing maintenance costs on the other. In conjunction with the coating of such stressed components, there are materials known in the art, such as for example, zirconium dioxide stabilized with yttriumoxide (yttrium stabilized $ZrO_2$, abbreviated "YSZ"). Coatings of this type are referred to as ceramic thermal barrier layers. Though they lack mechanical stability and integrity, and have a high specific weight, and though layers of this type are substantially permeable to oxygen, these materials remain unique in terms of protecting the surface of base metals, in particular of first stage rotor blades or guide vanes in low pressure gas turbines. It is here that especially high temperatures in the range of between 900 to 950° C. are known to occur. The uncooled third and fourth stages may be produced using titanium alloys, which exhibit a solid stability to density ratio, but which require protection from oxidation and corrosion.

The oxygenous, quasicrystalline titanium-based alloys proposed herein include internal ceramic intermediate layers. As such they protect the materials of the underlying component (metal, e.g. alloys) from oxidation, since diffusion of oxygen through the layer is inhibited. Moreover, their low thermal conductivity results in a decrease in surface temperature of the underlying metal of the compressor blades and of the gas turbine (particularly in the case of internal cooling). In other words, the proposed materials function both as a diffusion barrier (DB) and as a thermal carrier coating, abbreviated TBC). The reduced weight (as opposed to blades made of nickel-based super alloys) and the opportunity to observe the diffusion reaction between the coating and the base material ensure improved adhesion to the base material. Observation of the diffusion reaction may be made, e.g. by polishing samples and contacting them with a coating according to the present invention. Next, cross-sections may be made and TEM or SEM-images of such cross-sections taken, making the extent of diffusion then easily recognizable.

In order to test these properties different alloys were manufactured, in which 100 grams of each were fused in an arc. Such fusion took place within an atmosphere of cover gas, the cover gas used being argon. The individual samples were designated Ti-1 to Ti-4 and Ti-11 and Ti-12, the nominal compositions of which are summarized in the following Table 1:

TABLE 1

| No. | Nominal Composition | Peritectic Temp. (° C.) Liquidus Temp. (° C.) | EDX (at %) Ti | Cr | Si | Al | ρ (g cm$^{-3}$) | $c_p$ (J g$^{-1}$K$^{-1}$) (100° C.) | λ (Wm$^{-1}$K$^{-1}$) (100° C.) |
|---|---|---|---|---|---|---|---|---|---|
| Ti-1 | $Ti_{60}Cr_{32}Si_4(SiO_2)_4$ | 1270 | 62.8 | 28.8 | 8.4 | — | 5.234 | 0.557 | 7.35 |
| | (i-phase is main | 1580 | 36.7 | 57.0 | 6.3 | | | | |
| | phase) | | | | | | | | |
| Ti-2 | $Ti_{60}Cr_{25}Si_5(SiO_2)_{10}$ | 1525 | 57.8 | 33.9 | 11.7 | — | 5.099 | 0.591 | 8.30 |
| | (1/1 approximant as | 1665 | 32.6 | 53.7 | 13.7 | | | | |
| | main phase) | | 55.1 | 9.9 | 35.0 | | | | |
| Ti-3 | $Ti_{65}Cr_{25}Si_{2.5}(SiO_2)_{7.5}$ | 1310 | — | — | — | — | 4.960 | 0.531 | 7.03 |
| | (1/1 approximant as | 1575 | | | | | | | |
| | main phase) | | | | | | | | |
| Ti-4 | $Ti_{60}Cr_{30}(SiO_2)_{10}$ | 1275 | 57.8 | 29.7 | 12.5 | — | — | — | — |
| | (1/1 approximant as | 1535 | 34.6 | 57.1 | 8.3 | | | | |
| | main phase) | | 99.0 | 1.0 | | | | | |
| Ti-11 | $Ti_{60}Cr_{30}Al_2Si_3(SiO_2)_5$ | 1305 | 62.0 | 28.6 | 7.6 | 1.7 | 5.210 | 0.531 | 6.21 |
| | | 1585 | 37.1 | 57.8 | 4.8 | 0.6 | | | |
| Ti-12 | $Ti_{60}Cr_{30}Al_3Si_2(SiO_2)_5$ | 1315 | 63.0 | 29.7 | 5.3 | 1.9 | 5.030 | 0.763 | 10.40 |
| | | 1565 | 37.2 | 57.8 | 4.2 | 0.7 | | | |

After being fused, the embodiments Ti-1, Ti-2 and Ti-3 were tempered in a resistance furnace at a constant temperature of 1225° C. for a period of 144 hours, and in which the samples were maintained in an aluminum crucible in an argon atmosphere, after which they were allowed to cool in the furnace. The Ti-4 sample was tempered at 1080° C. for a period of 80 hours zirconium-crucible. Samples Ti-11 and Ti-12 were fused in similar fashion and tempered at a temperature of greater than 1000 degrees for a period of 50 hours.

Some of the properties of the six tested samples are shown in Table 1. In all cases the peritectic temperatures exceed 1200° C., and the liquidus temperatures exceed 1500° C. Because the melting points of the alloys are significantly higher than 1200° C., such compounds are in this respect suitable for use as a coating in gas turbines.

The differential thermal analysis was conducted in a device having the option of measuring temperatures as high as 3000° C. (HDTA, design of the Institute of Material Sciences Problems, Ukraine; see description in: Yu. A. Kocherjinksy, E. A. Shishkin and V. I. Vasilenko: "Phase Diagrams of Metallic Systems", "Nauka", Moscow, 1971, p. 245). The corresponding data are summarized in Table 2 with accompanying remarks:

TABLE 2

| Sample | Heating Temperature, ° C. | Heating Remarks | Cooling Temperature, ° C. | Cooling Remarks |
|---|---|---|---|---|
| Ti-1 | 1270 | Peritectic reaction | 1380 | Peritectic reaction |
| | 1315 | Return point | | |
| | 1330 | Phase transition | | |
| | 1350 | Return point | | |
| | 1580 | Liquidus | 1460 | Liquidus |
| | 1640 | Max. heating temp. | | |
| Ti-2 | 1525 | Peritectic reaction | | Peritectic reaction |
| | 1575 | Solidus | | |
| | 1635 | Solidus? | | |
| | 1665 | Liquidus | | Liquidus |
| | 1880 | Max. heating temp. | | |

TABLE 2-continued

| Sample | Heating Temperature, ° C. | Heating Remarks | Cooling Temperature, ° C. | Cooling Remarks |
|---|---|---|---|---|
| Ti-3 | 1310 | Peritectic reaction | 1380 | Peritectic reaction |
| | 1350 | Return point | | |
| | 1540 | Phase transition | 1470 | Phase transition |
| | 1575 | Liquidus | 1500 | Liquidus |
| | 1660 | Max. heating temp. | | |
| Ti-4 | 1275 | Peritectic reaction | 1390 | Peritectic reaction |
| | 1310 | Return point | | |
| | 1322 | Phase transition | | |
| | 1380 | Return point | | |
| | 1400 | Phase transition | | |
| | 1540 | Phase transition | 1500 | Phase transition |
| | 1580 | Phase transition | | |
| | 1600 | Liquidus | 1535 | Liquidus |
| | 1700 | Max. heating temp. | | |
| Ti-11 | 1305 | Peritectic reaction | 1355 | Peritectic reaction |
| | 1360 | Return point | | |
| | | | 1385 | Phase transition |
| | 1540 | Phase transition | 1515 | Phase transition |
| | 1570 | Return point | | |
| | 1585 | Liquidus | 1540 | Liquidus |
| | 1660 | Max. heating temp. | | |
| Ti-12 | 1315 | Peritectic Reaction | 1350 | Peritectic reaction |
| | 1350 | Return point | | |
| | 1355 | Phase transition | 1380 | Phase transition |
| | 1360 | Return point | | |
| | 1565 | Liquidus | 1475 | Liquidus |
| | 1630 | Max. heating temp. | | |

In addition, the composition of the phases determined with the aid of EDX (dispersive X-ray spectroscopy) is indicated in atom %. The first line in each case indicates the main phase of the corresponding alloys. Such measuring of phase concentration is performed by a JEOL JSM-6400 type scanning electron microscope equipped with an EDX-detector in conjunction with the VOYAGER software.

Also indicated in Table 1 is density, which was determined by a measurement of mass and of volume based on the Archimedes principle. To measure volume, a displacement medium in the form of water at a temperature of 20° C. was used. To prevent the liquid from penetrating the pores of the body during dip weighing, the body was saturated with the liquid once the dry weight was determined. A quenching subsequent to heating is especially suitable for materials having fine capillaries. To this end the sample bodies are dried at 110° C. to constant weight prior to quenching, then placed in water at ambient temperature. The water is heated to boiling and maintained at the boiling point for a minimum of 30 minutes. The comparatively low density renders the proposed compounds suitable for the coating of moving parts as a result of the small moving masses associated therewith.

Also indicated in Table 1 is heat capacity, measured at 100° C. Thermal capacity was measured constantly with the aid of differential thermo analysis (DTA), using a DSC 404/So type device of Netzsch (Germany), more specifically a highly vacuum-adapted special version of the DSC 404, which permits measurement of thermal capacities and latent heat from 0° C. up to 1400° C. using the heat flow method. With this method, heating rates of up to 20 K/min are possible. Measurement was taken in argon-atmosphere. The results were a comparatively low heat capacity advantageous for compounds of the aforementioned type.

Further, thermal conductivity $\lambda$ is also indicated in Table 1, measured at 100° C. Thermal conductivity was determined in accordance with the formula $\lambda=\alpha\rho c_p$ ($\alpha$ refers to temperature conductivity, $\rho$ refers to density, $c_p$ refers to heat capacity). Density and heat capacity measurements are indicated above. Temperature conductivity (TC) was measured using the laser flash method at specific temperature levels (room temperature, 100, 200, 400, 600, 800, 1000 and 1200° C.). At each temperature level 5–10 individual measurements were taken. From these a mean TC value was calculated at a temperature that was also averaged. The TC was measured using a Netzsch laser flash apparatus (Germany, measurement range—up to 2000° C.). The sample room is hermetically sealed off from the furnace room, enabling measurements to be taken under vacuum. The solid-state laser has a wavelength of 1064 nm and a maximum energy output of approx. 20 Joule per pulse. Pulse duration is variable between 0.2 and 1.2 ms. The thermal diffusivity $\alpha$ indicated in FIG. 6 was measured by using the laser flash method in an ACCESS apparatus (E. Pfaff. Report 72–00 (Sep. 20, 2000) of the Rhenish-Westfalian Technical University, Aachen).

FIGS. 1 to 4 show X-ray powder diffraction patterns of the samples according to Table 1, in which intensity (1) is represented as a function of diffraction angle (2 Theta). The measurements took place in a PADX Powder Diffractometer (Scintag, USA) apparatus, $\lambda$ by CU-irradiation, Ge-detector.

FIG. 1 shows different X-ray powder diffraction patterns of sample Ti-4, wherein the diffraction pattern for a sample Ti-4 tempered in a zirconium-dioxide crucible is shown in FIG. 1*a*). Moreover, in FIGS. 1*a*)–*c*) the peaks of structure $\alpha$(TiCrSi), that is, of the 1/1 approximant of cubic structure $Ti_{75-x}Cr_{25}Si_x$, in which 10<X<20, are indicated by quadrangles and arrows. The peaks associated with structure $Ti_5Si_3$ are indicated by quadrangles alone. Hence, the manner in which different structures are juxtaposed is clearly recognizable. The information with regard to arrangement was drawn from J. L. Libbert, J. Y.Kim and K. F. Kelton: "Oxygen in Ti(Cr, Mn)—Si Icosahedral Phases and Approximants."

FIG. 1*b*) shows a similar sample that was tempered in a graphite-crucible. FIG. 1*c* shows a sample that was not tempered.

Figure 2:
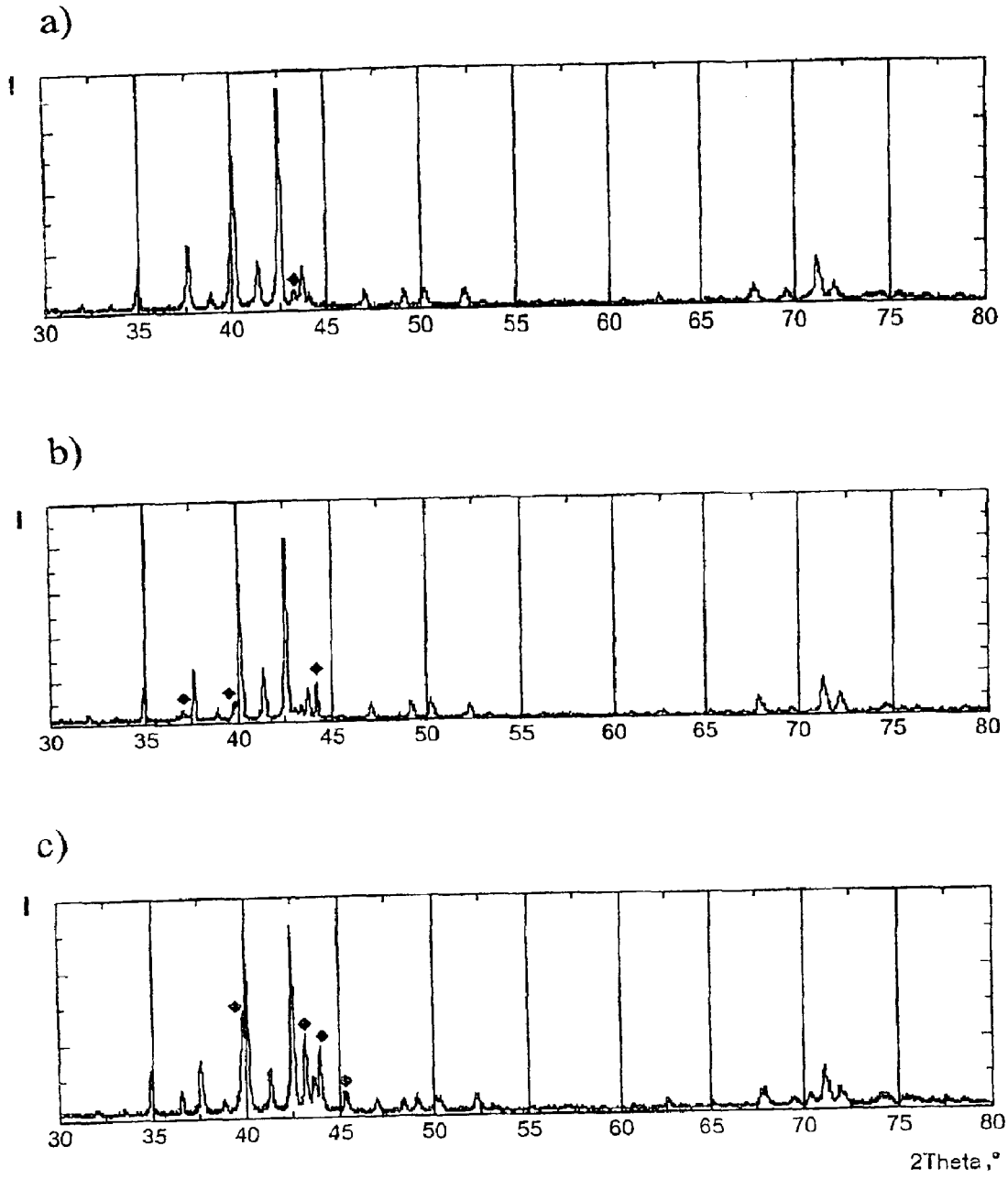
FIG. 2 displays x-ray diffraction data of the non-tempered examples Ti-1 (a), Ti-2 (b) and Ti-3 (c) (Vacumet method)

FIG. 2 shows corresponding diffraction patterns of samples Ti-1 (FIG. 2*a*, non-tempered, VACUMET), Ti-2 (FIG. 2*b*, non-tempered, VACUMET) and Ti-3 (FIG. 2*c*, non-tempered, VACUMET). VACUMET is defined as the fusing of Ti-alloys in an induction furnace under vacuum at low argon-partial pressure (15 Torr) in a specially prepared graphite crucible. Here too, the individual phases may be juxtaposed to one another.

Figure 3:
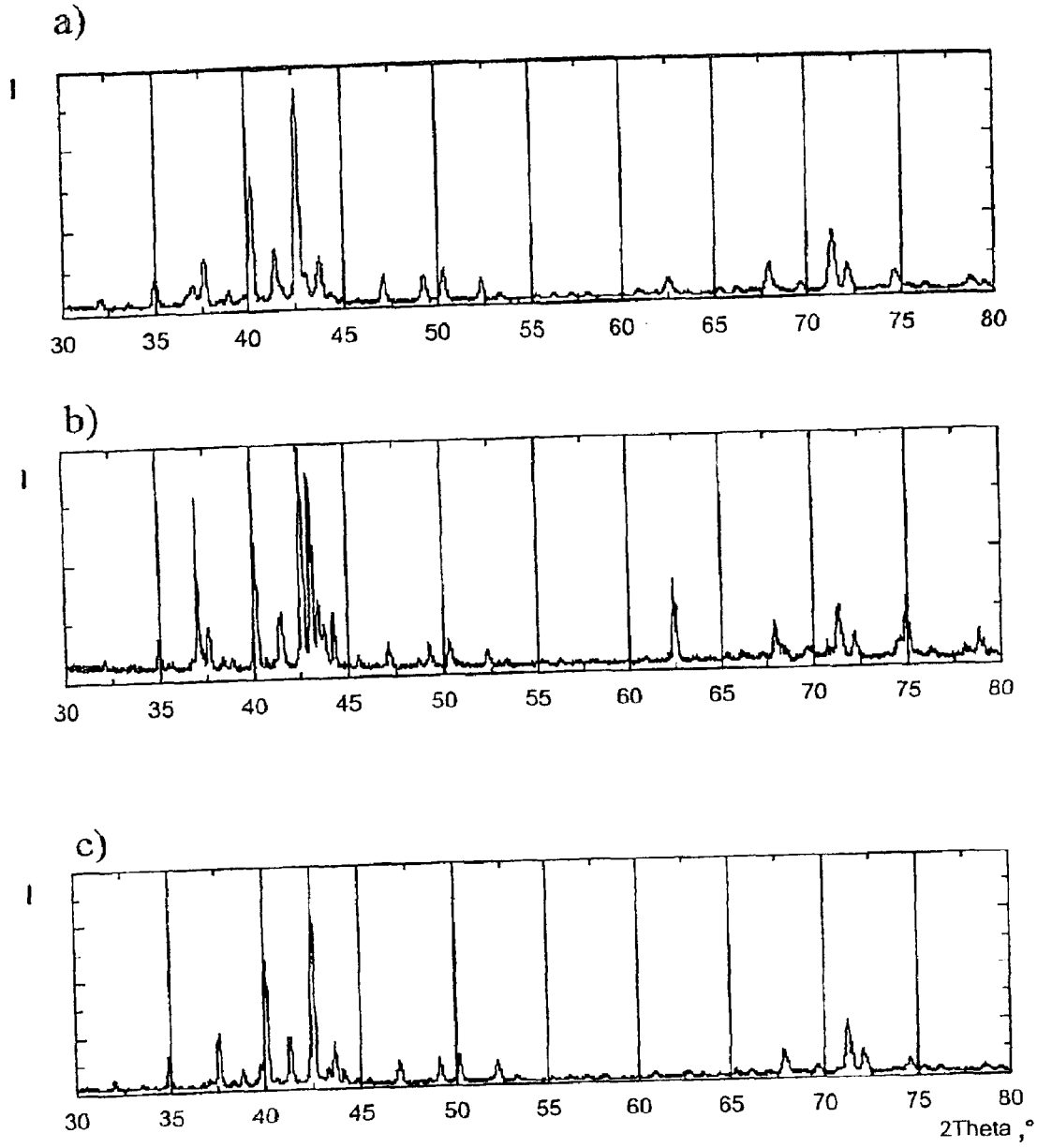
FIG. 3 displays x-ray diffraction data of example Ti-2, in which a) is the spectrum for a tempered sample, b) is the spectrum for a non-tempered sample, and c) is the spectrum for a non-tempered sample (Vacumet method)

FIG. 3 shows a diffraction pattern of sample Ti-2, in which a) represents a tempered sample, b) a non-tempered sample and c) a non-tempered sample in the VACUMET-method.

Here too, the juxtaposition of the different structures is clearly recognizable. Moreover, in the case of the present sample the differences between the tempered and non-tempered samples are evident, and it is clear that, at least with respect to the diffraction pattern, tempering generates a structure similar to a process in accordance with VACUMET.

Figure 4:
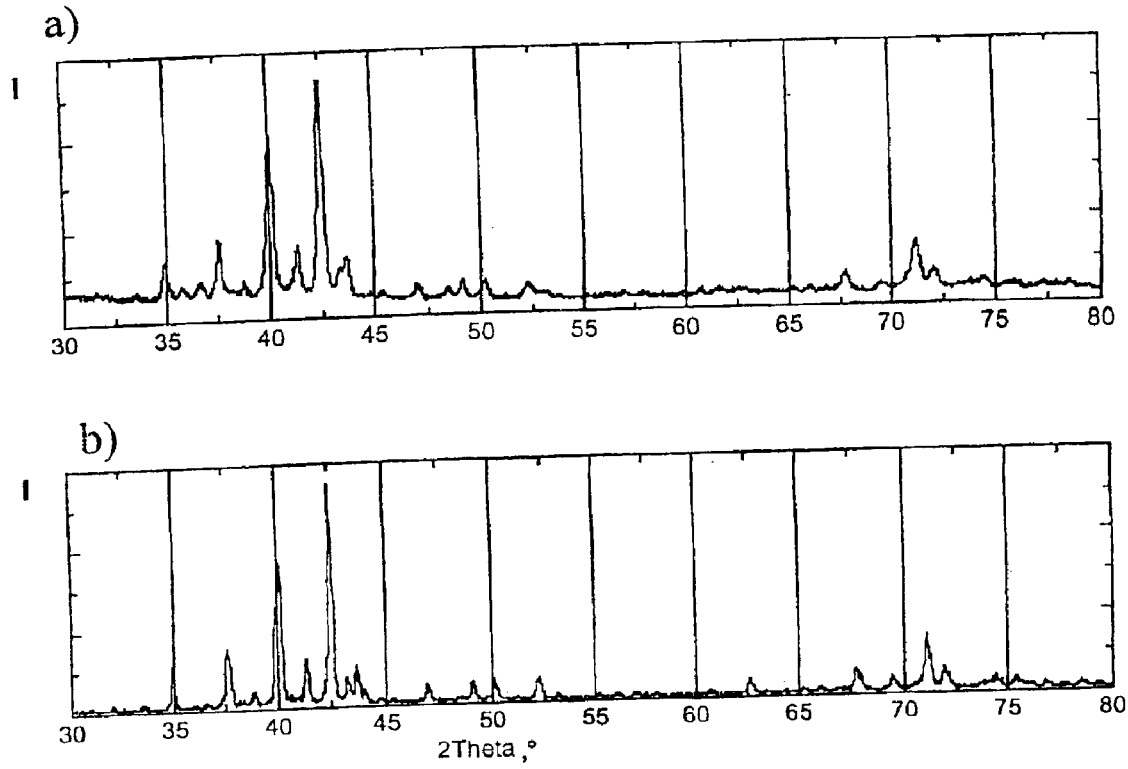
FIG. 4 displays x-ray diffraction data of example Ti-3, in which a) is the spectrum for a tempered sample, and b) is the spectrum for a non-tempered sample (Vacumet method)

FIG. 4 shows corresponding diffraction patterns for different methods of manufacture of sample Ti-3 (a: tempered; b: non-tempered, VACUMET). It can be seen here as well how both methods of manufacture produce similar structures, at least vis-à-vis their diffraction patterns.

Figure 5:
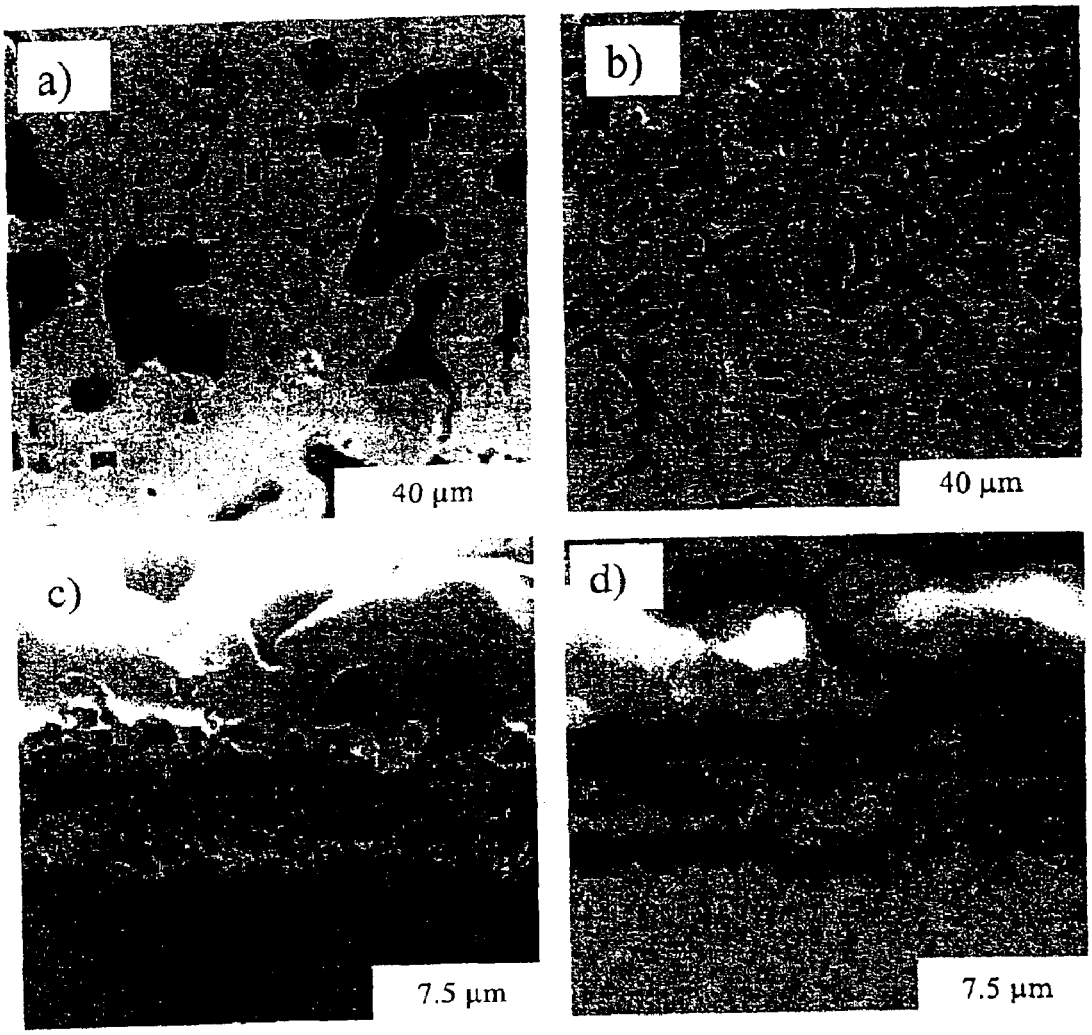
FIG. 5 displays scanning electron microscope images (SEM), a) backscattering pattern of the annealed sample Ti-2; b) backscattering pattern of the annealed sample Ti-4; c) and d) normal patterns and backscattering patterns of sample Ti-2, following oxidation at 800° C. in air for a period of 500 hours.

As shown in FIG. 5, the samples were also examined under a Hitachi S-900 "in-lens" field-emission scanning electron microscope with an accelerating voltage of 30 kV, utilizing a standard—Everhard-Thornley SE Detector and a YAG type BSE-detector. The various structures and domain sizes are visible from the back-scattering patterns of FIGS. 5*a*) and *b*). The bright areas indicate the alpha-phases, the dark areas indicate the phase derived from $Ti_5Si_3$. It is evident that larger domains occur in the Ti-2 sample (FIG. 5*a*) than in the Ti-4 sample. Both images are surface images and reflect the measurements of tempered samples.

FIG. 5*c*) is a normal SEM-image of sample Ti-2 after having undergone oxidation at 800° C. for 500 hours. The uppermost bright layer consists of $TiO_2$, the intermediate layer just beneath the former consists of $CrO_2$, between which, circumstances permitting, an adhesion layer is disposed. The alloy itself is depicted in the bottom-most region at the lower edge of the image. 5*d*) is a back-scattering image of the same sample. Both FIGS. 5*c*) and 5*d*) are cross-sectional images at a right angle to the sample surfaces.

Figure 6:
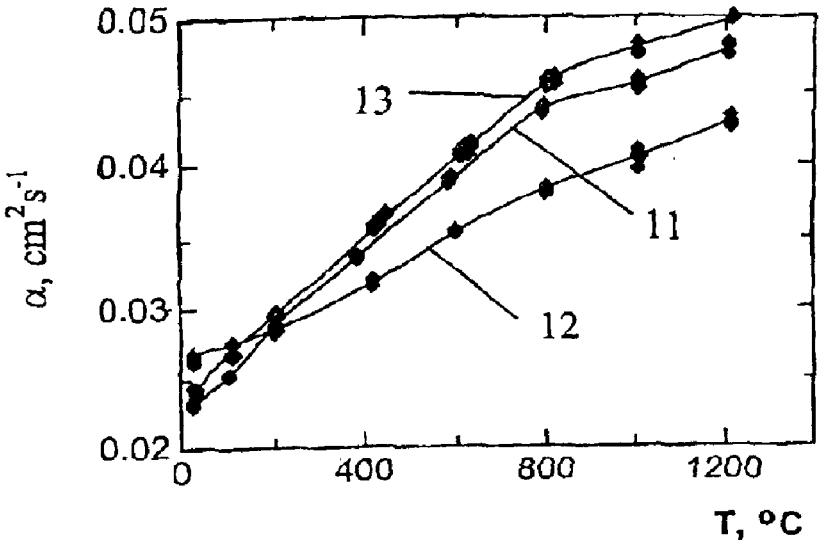
FIG. 6 shows the thermal diffusivity of samples Ti-1, Ti-2 and Ti-3.

FIG. 6 shows the thermal diffusivity of samples Ti-1 (reference numeral 11), Ti-2 (reference numeral 12), Ti-3 (reference numeral 13). Thermal diffusivity is a material property that reflects the rate at which heat is diffused through a body. It is a function of the thermal conductivity of said body and of its thermal capacity. Elevated thermal conductivity increases the thermal diffusivity of the body because it permits rapid movement of heat through the body. Conversely, high thermal capacity will lower the thermal diffusivity of the body, since conveyed heat is preferably stored within the body and no longer conducted through it. FIG. 6 shows clearly how at high temperatures sample Ti-2 in particular exhibits low thermal diffusivity, which is advantageous in terms of the proposed uses. In principle, increasing thermal diffusivity is found to coincide with increasing temperature as expected.

Figure 7:
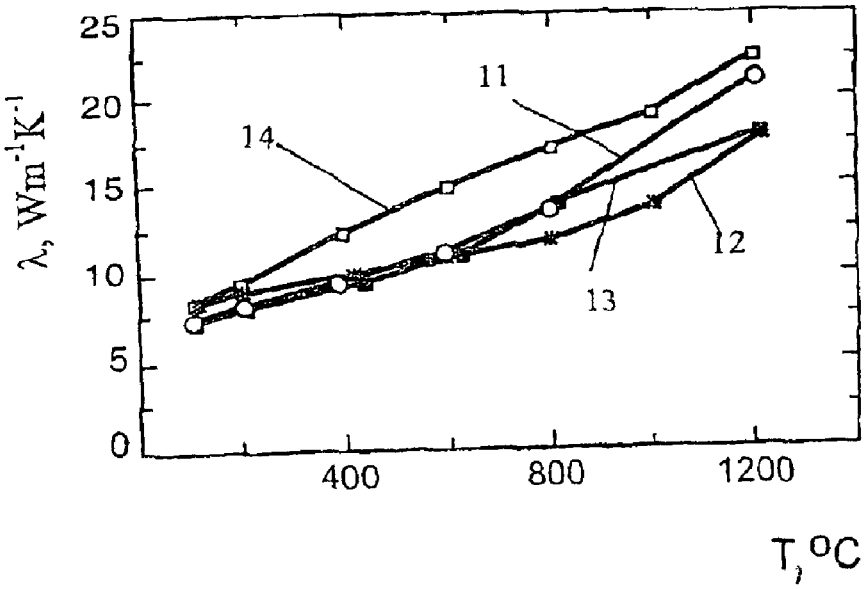
FIG. 7 shows a comparison of the thermal conductivity of samples Ti-1, Ti-2, Ti-3 and Ti-4.

FIG. 7 shows the thermal conductivity of samples Ti-1 (reference numeral 11), Ti-2 (reference numeral 12), Ti-3 (reference numeral 13), in addition to Ti-4 (reference numeral 14). Low thermal conductivity is again observable, in particular for sample Ti-2. It should be pointed out, however, that thermal conductivity of a corresponding layer of YSZ would be even lower, though a layer of the latter type is significantly more brittle and has significantly less mechanical strength than all of the alloys proposed herein, which as metals exhibit characteristic ductile properties. On the whole, only a relatively broad variation in thermal conductivity is revealed across the observed and relevant temperature range.

Figure 8:
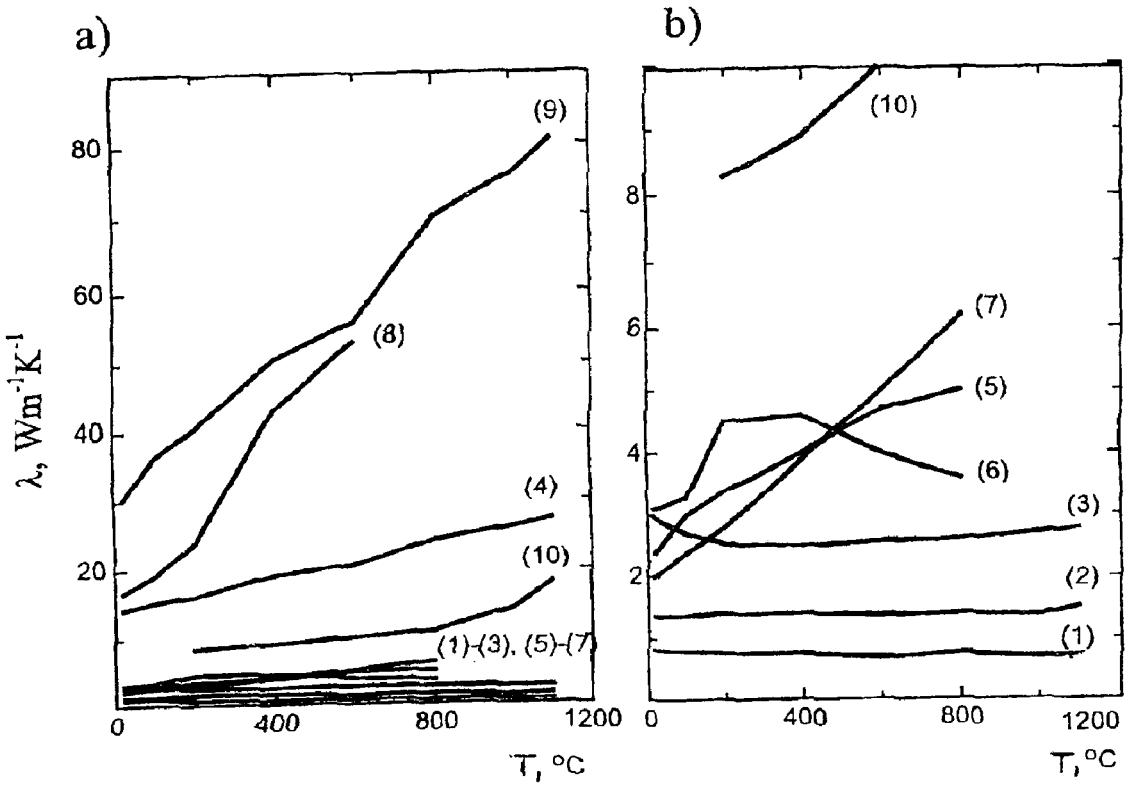
FIG. 8 shows a comparison of the thermal conductivity of Ti-2 with various prior art samples.

FIG. 8 shows the thermal conductivity of a plurality of samples as compiled in the list of reference numerals. It can be seen that the thermal conductivity of the reference samples Ti-2 (reference numeral 10) falls within the median range. Typical samples of YSZ (yttrium stabilized $ZnO_2$) have lower values, as do corresponding AlCo-alloys (reference numerals 5–7). As previously mentioned in conjunction with FIG. 7, these samples have mechanical properties that are inferior to those of the proposed compounds.

Figure 9:
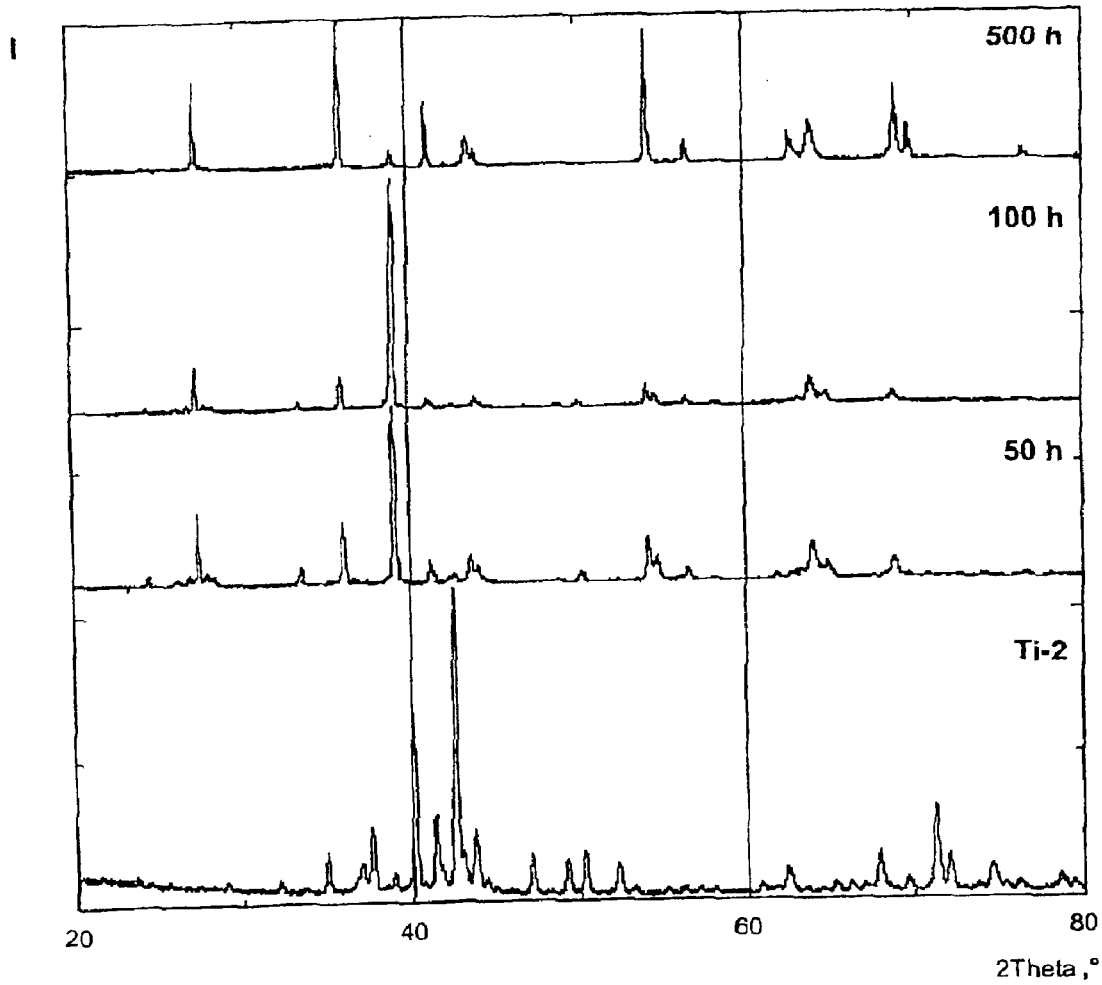
FIG. 9 displays X-ray diffraction data of example Ti-2 after different periods of oxidation in air at 950° C.
Figure 10:
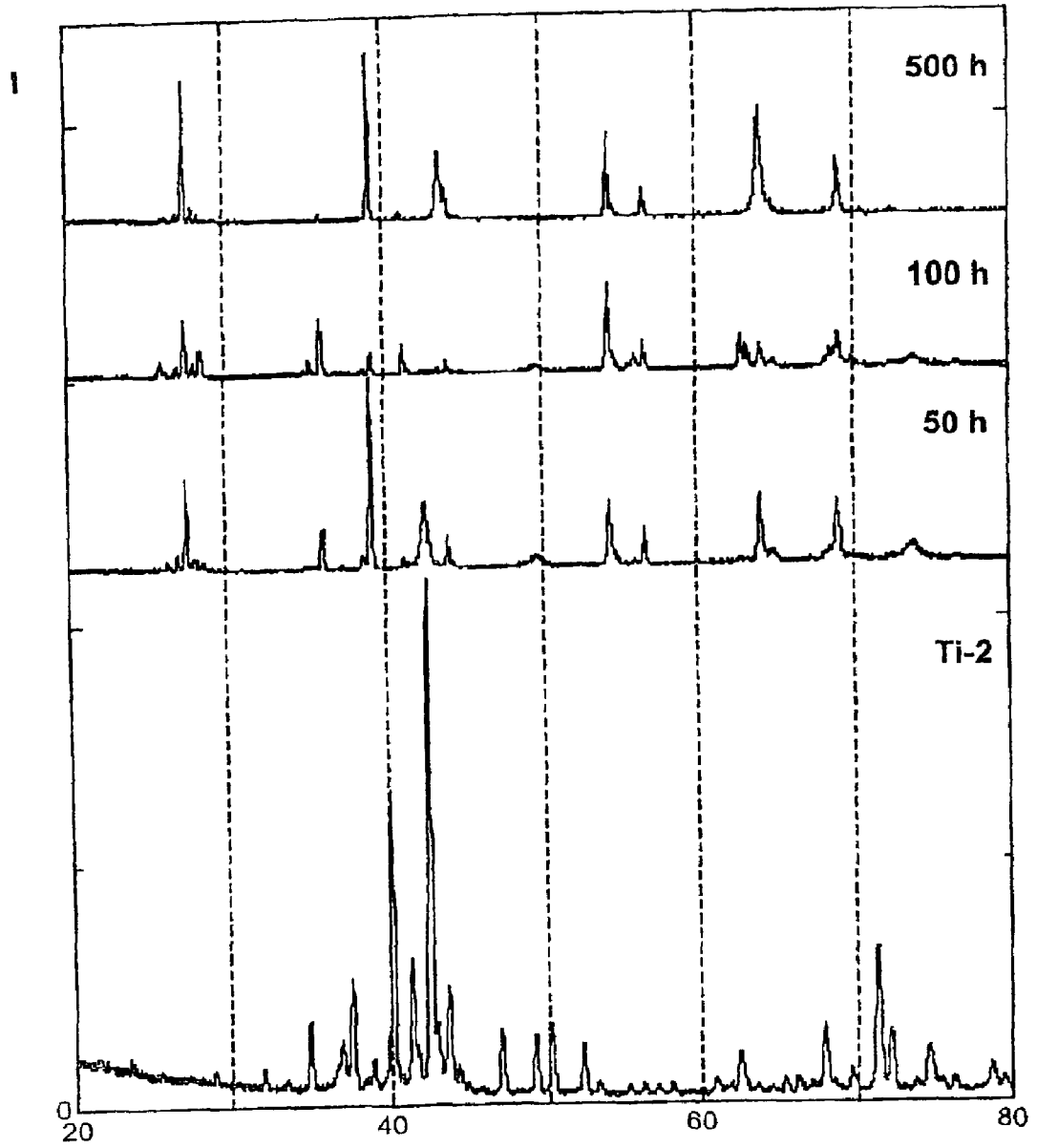
FIG. 10 displays X-ray diffraction data of example Ti-2 after different periods of oxidation in air at 1100° C.
Figure 11:
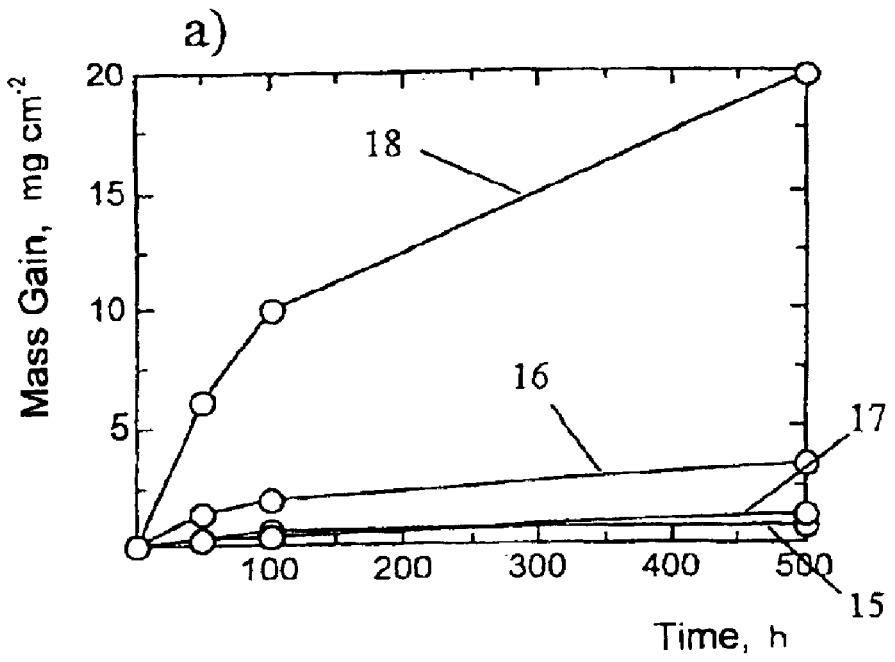
FIG. 11 shows oxidation kinetics, a) comparison of the oxidation of Ti-2 and TiAl; b) comparison of the oxidation of Ti-2 both tempered and non-tempered.
Figure 11:
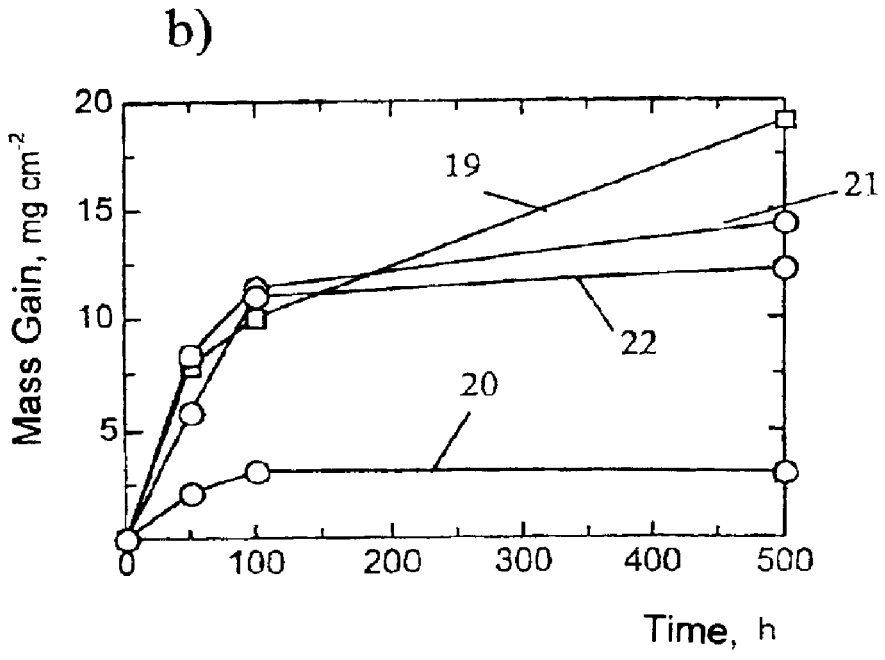

FIG. 9 shows the powder diffraction pattern of sample Ti-2, in which measurements were taken at various times during oxidation. This is a sample that prior to oxidation was manufactured in a process that included the step of tempering. Here, oxidation occurred in air at 950° C. It can be seen how successive oxides form at the surface, but how after approximately 50 hours the condition essentially stabilizes. FIG. 10 shows the corresponding pattern for the same sample, in which case oxidation is carried out at 1100° C. Behavior similar to FIG. 9 is found here. The oxidation kinetics were also examined and are illustrated in FIG. 11. Since slow oxidation is preferred, the sample tempered at 800° C. according to FIG. 11*a*) is shown to stand out. Tempering occurred for a period. The standard material employed was TiAl. The superiority of samples that have been tempered is evident, in particular in FIG. 11*b*), whereby tempering at a low temperature generally appears to result in greater stability vis-à-vis oxidation.

LIST OF REFERENCE NUMERALS

1 YSZ,PVD
2 YSZ, plasmaspray
3 YSZ, sintered
4 Stainless steel
5 $Al_{71.1}Co_{13}Fe_8Cr_8$
6 $Al_{70.1}Co_{14}Ni_{16}$, heated
7 $Al_{71.1}Co_{13}Ni_{15.2}$+$Al_{74.2}Co_{12.4}Ni_{13.4}$, heated
8 Ni-alloy
9 Ti-alloy
10 Sample Ti-2
11 Ti-1
12 Ti-2
13 Ti-3
14 Ti-4
15 Ti-2, tempered at 800° C.
16 Ti-2, tempered at 950° C.
17 TiAl, tempered at 800° C.
18 TiAl, tempered at 950° C.
19 Ti-2, non-tempered, cast at 950° C.
20 Ti-2, annealed at 950° C.
21 Ti-2, non-tempered, cast at 1050° C.
22 Ti-2, annealed at 1050° C.

What is claimed is:

1. An icosahedral, quasicrystalline compound, or compound present in the form of an approximant, having the nominal composition:

$$Ti_vCr_wAl_xSi_yO_z$$

in which v=60–65 w=25–30 x=0–6 y=8–15 z=8–20 and in which the atom percent of oxygen is in the range of 8 to 15%, and the atom percent of aluminum is in the range of 2 to 5%.

2. A compound according to claim 1, wherein v=60 w=30 x=0–3 y=8–15 z=8–20 in which the atom percent of oxygen is in the range of 8 to 12%, and the atom percent of aluminum is in the range of 1.5 to 3%.

3. A compound in accordance with claim 2, wherein y=8–10.

4. A compound in accordance with claim 2, wherein z=8–10.

5. A compound according to claim 1, wherein v=60 w=30 x=0–2 y=8–10 in which the atom percent of oxygen is in the range of 10%, and the atom percent of aluminum is in the range of 1.5 to 2.5%.

6. A compound according to claim 1, comprising at least one composition selected from the group consisting of: $Ti_{60}Cr_{32}Si_4(SiO_2)_4$; $Ti_{60}Cr_{25}Si_5(SiO_2)_{10}$; $Ti_{65}Cr_{25}Si_{2.5}(SiO_2)_{7.5}$; $Ti_{60}Cr_{30}(SiO_2)_{10}$; $Ti_{60}Cr_{30}Al_2Si_3(SiO_2)_5$; $Ti_{60}Cr_{30}Al_3Si_2(SiO_2)_5$; $Ti_{60}Cr_{30}Al_2Si_3(SiO_2)_5$; and $Ti_{60}Cr_{30}Si_5(SiO_2)_5$.

7. A method for manufacturing the compound of claim 1 comprising:

selecting the components of the compound; and fusing the components in a cover gas or vacuum.

8. A method according to claim 7, wherein fusing comprises fusing in an arc.

9. A method according to claim 7, further comprising:

applying the compound as a coating to a material, wherein applying comprises plasma spray or vapor deposition, followed optionally by tempering.

10. A method according to claim 7, further comprising:

tempering the compound after fusing.

11. A method according to claim 10, wherein tempering comprises tempering in steps, said steps comprising graduated increases in temperature, graduated decreases in temperature, or combinations thereof.

12. A method in accordance with claim 10, wherein tempering comprises tempering in a furnace, and further comprising cooling in the furnace.

13. A method in accordance with claim 10, wherein tempering comprises tempering at a temperature in the range of between 1000 and 1300° C., for a period of 80 to 200 hours.

14. A method in accordance with claim 10, wherein tempering comprises tempering for 7 days at 1100° C.

15. A method of use of the compound of claim 1 comprising:

exposing the compound to temperatures and gases present in a gas turbine or compressor.

16. A method of use of a compound according to claim 15, wherein exposing comprises exposing as a component of a gas turbine or of a compressor.

17. A method in accordance with claim 16, wherein the component comprises a rotor blade or a guide vane of a gas turbine or of a compressor.

18. A method of use according to claim 15 wherein the compound comprises a coating on a surface directly exposed to the gases, and further optionally comprising a second functional layer made of said material disposed underneath the coating for providing adhesion and as an additional barrier.

19. A method of use according to claim 18, wherein the coating has a thickness in the range of between 10–400 μm.

20. A method in accordance with claim 19, wherein the coating has a thickness in the range of between 100 to 200 μm.

* * * * *